US010106934B2

(12) United States Patent
Hofer et al.

(10) Patent No.: US 10,106,934 B2
(45) Date of Patent: Oct. 23, 2018

(54) WORKHEAD ASSEMBLY

(71) Applicant: HARSCO TECHNOLOGIES LLC, Fairmont, MN (US)

(72) Inventors: Brett Hofer, Fairmont, MN (US); Michael L. Petersen, Scottville, MI (US); John Mustard, West Columbia, SC (US)

(73) Assignee: HARSCO TECHNOLOGIES LLC, Fairmont, MN (US)

( * ) Notice: Subject to any disclaimer, the term of this patent is extended or adjusted under 35 U.S.C. 154(b) by 322 days.

(21) Appl. No.: 15/072,693

(22) Filed: Mar. 17, 2016

(65) Prior Publication Data

US 2016/0273170 A1 Sep. 22, 2016

Related U.S. Application Data

(60) Provisional application No. 62/134,317, filed on Mar. 17, 2015, provisional application No. 62/206,099, filed on Aug. 17, 2015.

(51) Int. Cl.

*E01B 19/00* (2006.01)
*E01B 29/00* (2006.01)
*E01B 27/16* (2006.01)

(52) U.S. Cl.

CPC ..... *E01B 29/00* (2013.01); *E01B 27/16* (2013.01)

(58) Field of Classification Search

CPC .... E01B 29/00; E01B 2203/125; E01B 27/17; E01B 2203/12; E01B 2203/122; E01B 2203/127; E01B 27/16

USPC ..... 104/12

See application file for complete search history.

(56) References Cited

U.S. PATENT DOCUMENTS 4,445,437 A * 5/1984 Nielsen ..... E01B 27/16 104/12
4,913,058 A * 4/1990 Mancini ..... E01B 27/16 104/12
5,127,334 A 7/1992 Theurer
6,968,786 B2 11/2005 Theurer
7,383,777 B2 6/2008 Theurer et al.
2007/0039509 A1 2/2007 Straub et al.

(Continued)

FOREIGN PATENT DOCUMENTS

WO 2014144739 A1 9/2014

OTHER PUBLICATIONS

An International Preliminary Report on Patentability issued by the International Bureau on behalf of the International Searching Authority dated Sep. 19, 2017.

(Continued)

*Primary Examiner* — Mark T Le
(74) *Attorney, Agent, or Firm* — Baker & McKenzie LLP

(57) ABSTRACT

A rail vehicle includes a rail vehicle frame, a pocket, a first beam, a second beam, an endplate, an actuator and a workhead carrier. The pocket is coupled to a frame portion of the rail vehicle frame. The first beam is disposed in a cavity defined by the pocket. The second beam is disposed proximal to the first beam. The end plate couples the first beam and the second beam. The actuator extends the first and second beams such that the end plate is displaced transversely with respect to the rail vehicle frame. The work head carrier is operable to translate along the first and second beams and couple the second beam to the frame portion.

20 Claims, 16 Drawing Sheets

(56) References Cited

U.S. PATENT DOCUMENTS

| | | | |
|---|---|---|---|
| 2010/0293819 | A1 | 11/2010 | Huebner et al. |
| 2014/0013991 | A1 | 1/2014 | Delucia et al. |
| 2014/0352569 | A1 | 12/2014 | Vargas et al. |

OTHER PUBLICATIONS

International Search Report and Written Opinion dated Jun. 15, 2016 in International Patent Application No. PCT/US2016/022808.

* cited by examiner

WORKHEAD ASSEMBLY

CROSS REFERENCE TO RELATED APPLICATIONS

This application claims priority to U.S. Provisional Application Nos. 62/134,317, filed Mar. 17, 2015 and 62/206,099, filed Aug. 17, 2015, the entirety of each of which are incorporated by reference in their entirety.

BACKGROUND

The present disclosure relates to a rail vehicle having carriage workhead assemblies that are rotatable and transversely displaceable.

Generally, a railroad includes at least one pair of elongated, substantially parallel rails coupled to a plurality of laterally extending ties, which are disposed on a ballast bed. The rails are coupled to the ties by tie plates and spikes and/or spring clip fasteners, which is an example of a class of fasteners that may be referred to as anchors. The ballast is generally hard particulate material such as, but not limited to, gravel. The ballast filled space between ties is referred to as a crib. Ties may be crooked or skewed and not extend generally laterally, e.g. perpendicular to, the rails.

During installation and maintenance, various operations may be performed. For example, ballast may need to be tamped, or compressed, to ensure that the ties, and therefore the rails do not shift and are positioned correctly; anchors may need to be tightened; or ties may need to be replaced. Track maintenance activities generally require a vehicle that travels on the track and carries workheads that perform the maintenance activities.

When performing maintenance operations on a track, such as a tamping operation, the spacing of the rails of the track may vary. This variance may be because the track is out of alignment and needing maintenance operations. It may also be because a location such a switch has been reached that has different rail spacing than at another point in the track. It would be desirable to have a workhead assembly that is transversely displaceable that can accommodate these variations in spacing of the rails. It would also be desirable to have a workhead assembly that can rotate to provide greater flexibility in positioning tools of the workheads and more easily accommodate variation such as curves in the track.

BRIEF SUMMARY

In an embodiment, a rail vehicle includes a rail vehicle frame, a pocket, a first beam, a second beam, an endplate, an actuator and a workhead carrier. The pocket is coupled to a frame portion of the rail vehicle frame. The first beam is disposed in a cavity defined by the pocket. The second beam is disposed proximal to the first beam. The end plate couples the first beam and the second beam. The actuator extends the first and second beams such that the end plate is displaced transversely with respect to the rail vehicle frame. The work head carrier is operable to translate along the first and second beams and couple the second beam to the frame portion.

In another embodiment, a rail vehicle includes a first carriage assembly, a second carriage assembly, a connection beam and a third actuator. The first carriage assembly includes a first pocket, a first beam, a second beam, a first end plate, a first actuator and a first workhead carrier. The first pocket is defined in a frame of the first carriage assembly. The first beam is disposed in a cavity defined by the pocket. The second beam is disposed proximal to the first beam. The first end plate couples the first beam and the second beam. The first actuator extends the first and second beams such that the first end plate is displaced transversely with respect to the rail vehicle frame. The first workhead carrier is operable to translate along the first and second beams and couple the second beam to the frame of the first carriage assembly. The second carriage assembly includes a second pocket, a third beam, a fourth beam, a second end plate, a second actuator, and a second workhead carrier. The second pocket is defined in a frame of the first carriage assembly. The third beam is disposed in a cavity defined by the second pocket. The fourth beam is disposed proximal to the first beam. The second end plate couples the first beam and the second beam. The second actuator extends the third and fourth beams such that the second end plate is displaced transversely with respect to the rail vehicle frame. The second workhead carrier is operable to translate along the first and second beams and couple the second beam to the frame of the second carriage assembly. The connection beam couples the first carriage assembly to the second carriage assembly. The third actuator displaces the first carriage assembly in the longitudinal direction with respect to the rail vehicle frame.

In another embodiment, a method of performing maintenance on a track includes: providing a first carriage assembly that includes a transversely deployable dual beam assembly and a plurality of workhead carriers that translate along the dual beam assembly, the first carriage assembly being operable to rotate about a vertical pin; providing a second carriage assembly that includes a transversely deployable dual beam assembly and a plurality of workhead carriers that translate along the dual beam assembly, the second carriage assembly being operable to rotate about a vertical pin, and the second carriage assembly being coupled to the first carriage assembly by a connection beam; extending at least one of the dual beam assemblies; and translating at least one of the dual beam assemblies in a longitudinal direction.

BRIEF DESCRIPTION OF THE DRAWINGS

For a better understanding of the aforementioned embodiments as well as additional embodiments thereof, reference should be made to the Detailed Description below, in conjunction with the following drawings in which like reference numerals refer to corresponding parts throughout the figures.

DETAILED DESCRIPTION

Figure 1:
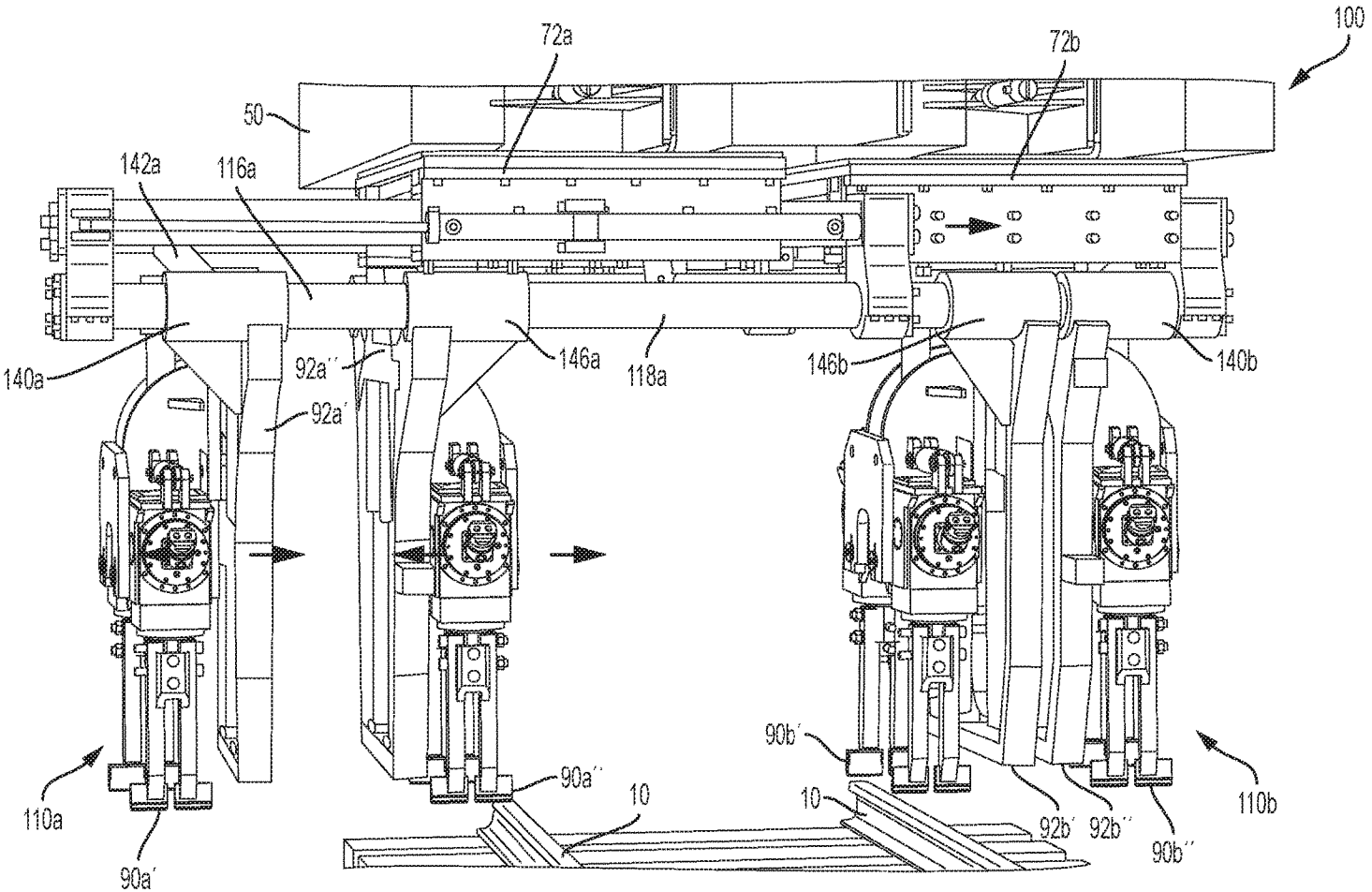
FIG. 1 illustrates a perspective view of exemplary workhead assemblies.

Embodiments described herein relate generally to an apparatus for railway maintenance and methods for performing railway maintenance. In some embodiments, an improved railway maintenance vehicle is provided. In other embodiments, an improved work head is provided. It will be appreciated that the following discussion is exemplary in nature of the described principles. For example, unless specifically described to the contrary, it will be understood that the various described embodiments may be used separately or together whether or not a specific combination is described or a particular aspect is described independently.

Referring to FIGS. 1-4, a maintenance vehicle 100 includes the workhead assemblies 110*a* and 110*b* that perform maintenance operations with respect to the rails 10. It will be appreciated that the inclusion of two workhead assemblies respectively associated with the two rails 10 is exemplary in nature. Any number of assemblies can be included. For example, one assembly may be provided, one assembly may be provided that has sufficient transverse displacement to perform work on both rails, three workhead assemblies may be provided including a centrally placed workhead for more efficient work at switches, four workhead assemblies may be provided with different working operations or more workheads per rail, and so forth.

The following discussion of the workhead assembly 110*a* is also applicable to the workhead assembly 110*b*. It will be appreciated that certain aspects, such as the direction of the extension of the dual beam assembly 112 will operate in the opposite direction for the workhead assembly 110*b* in view of its position at the opposite side of the track. That is, where a movement is described with respect to the workhead assembly 110*a* that results in a motion inward towards the center of the track, that motion is still inward toward the center of the track for the workhead assembly 110*b* with the actual direction of motion being complementary to that of the workhead assembly 110*a*. Otherwise, the operation of the workhead assembly 110*a* is the same as that described for the workhead assembly 110*b*. Where the operation of parts is similar or complementary, reference will be made to the reference numeral without the "a" or "b" designation, which will be understood to apply to the "a" part and similarly to the "b" part.

In the following discussion, a longitudinal direction generally refers to the direction of the track, a transverse direction generally refers to a direction other than the direction of the track (for example to the side when facing in the longitudinal direction), and a vertical direction generally refers to an upward/downward direction with respect to the track. A vertical direction may be orthogonal to the longitudinal and transverse directions.

Figure 2:
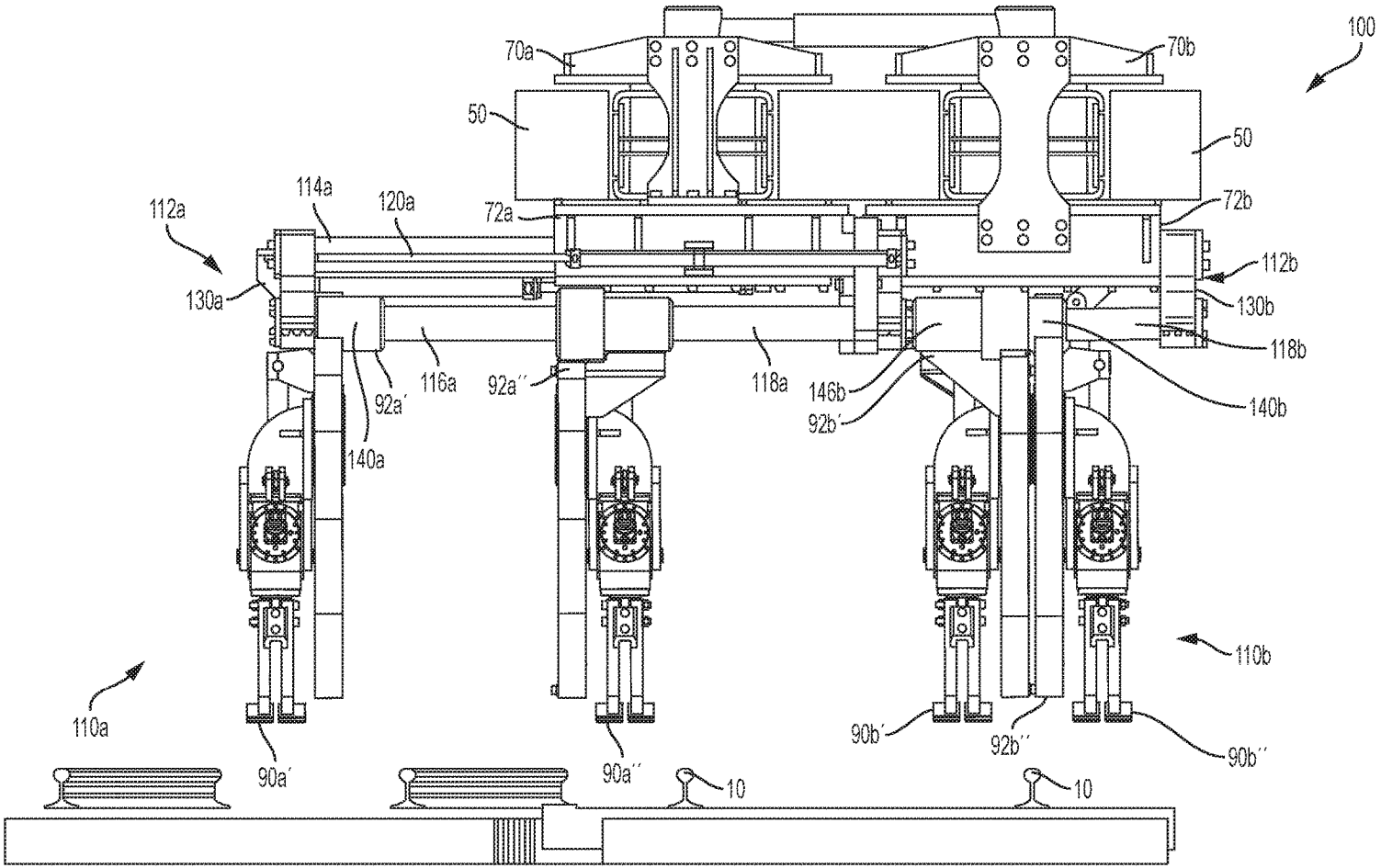
FIG. 2 illustrates a front view of the exemplary workhead assemblies of FIG. 1.

The workhead assembly 110 is coupled to the frame 50 of a rail vehicle via the carriage 70. The workheads 90' and 90" are respectively coupled to the carriage 70 via carriers 92' and 92". The carriage 70 includes a dual beam assembly 112 that includes an upper beam 114 and a lower beam 116. The dual beam assembly 112 is transversely (e.g., transverse to the longitudinal axis of the track) extendable from a subframe 72 of the carriage 70. A front actuator 120 and a back actuator 122 may extend and retract the dual beam assembly 12. The actuators 120 and 122 may be hydraulic actuators. In FIG. 2, the workhead assembly 110*a* is shown with the dual beam assembly 112*a* extended and the workhead assembly 110*b* is shown with the dual beam assemble 112*b* retracted. It will be appreciated that extension refers to the positioning of the dual beam assembly in an outward (e.g., away from the center of the vehicle) direction. The dual beam assembly itself is not required to extend or change length to accomplish this operation. The beams of the dual beam assembly may be fixed in length and translated outwardly to effect the extension. Similarly, the beams may by retracted by translating the beams inwardly (towards the center of the vehicle) and retraction of the beam itself is not required.

The upper beam 114 may be a square or rectangular beam of smaller cross-sectional dimension than a pocket weldment 124 of the carriage subframe 72. The pocket weldment may be provided by a plurality of plates welded into a square or rectangular shape complementary to the shape of the upper beam 114. A rectangular (or square) beam and a pocket weldment is preferred to reduce rotation of the workheads 90 about the dual beam assembly 112 and increase the strength of the workhead assembly 110. Rail maintenance operations such as tamping operations where pincer-like motion compresses ballast adjacent to and underlying rails have very high forces and therefore additional support provided by the square beam and pocket weldment and increase longevity of the machine. Of course, other types of rail workheads, such as anchor adjusters, may also be carried by the carrier assemblies to perform rail maintenance operations.

In some embodiments, the upper beam is a square beam and the pocket assembly defines a cavity substantially corresponding in shape to the upper beam to thereby accommodate the upper beam in the pocket assembly. It should be understood that while the upper beam is shown as a square beam, other alternatives, such as a cylindrical beam, may be provided.

An inner portion of the lower beam 116*a* may be referred to as the beam 118*a* and an outer portion of the lower beam 116*b* may be referred to as beam 118*b*. It will be appreciated that the beams 116 and 118 may refer to the same fixed beam or that the beam 116*a*/118*b* may extend from the beam 118*a*/116*b*.

The upper beam 114 and the lower beam 116 may remain in an extended position during operation of the workheads.

During work, vibrations having significant energy may be imparted to the beams. The upper beam 114 and the lower beam 116 maybe coupled in several locations to reduce beam flexure due to vibrations. Such flexure can lead to reduced life of the equipment. Ends of the upper beam 114 and the lower beam 116 may be coupled via the end plate 130 at one end and the carriage subframe 72 at an other end. The carrier 92' includes a sleeve 140 to couple to and travel on the lower beam 116. The carrier 92" includes sleeve 146, which may have an end slightly larger than the sleeve 140 such that the carriers 92' and 92" may be positioned closer together. Alternatively, the sleeve 140 may have the end that is slightly larger than the sleeve 146 so that the sleeves 140 and 146 do not interfere when the carriers 92' and 92" are brought together. In an example, the sleeve 140 may be disposed inside the sleeve 146. In another example, the sleeve 146 may be disposed inside the sleeve 140. The sleeves 140 and 146 may both slide along the beam 116 individually.

The carrier 92*a*" and 92*b*' (e.g., the inner carriers) may also include the protrusion 150, which preferably has an upper cross-sectional width greater than a lower cross-sectional width closer to the sleeve 146. The protrusion 150 may be disposed in a transverse slot 152 of the carriage subframe 72. In a particular embodiment, the protrusion 150 has a dovetail shape and the slot 152 is provided by a pair of rails 154 and 156 coupled to the subframe 72, for example via screws or welding. In this way, the upper beam 114 and the lower beam 116 are coupled at three points and the carriers 92' and 92" are independently displaceable.

Figure 3:
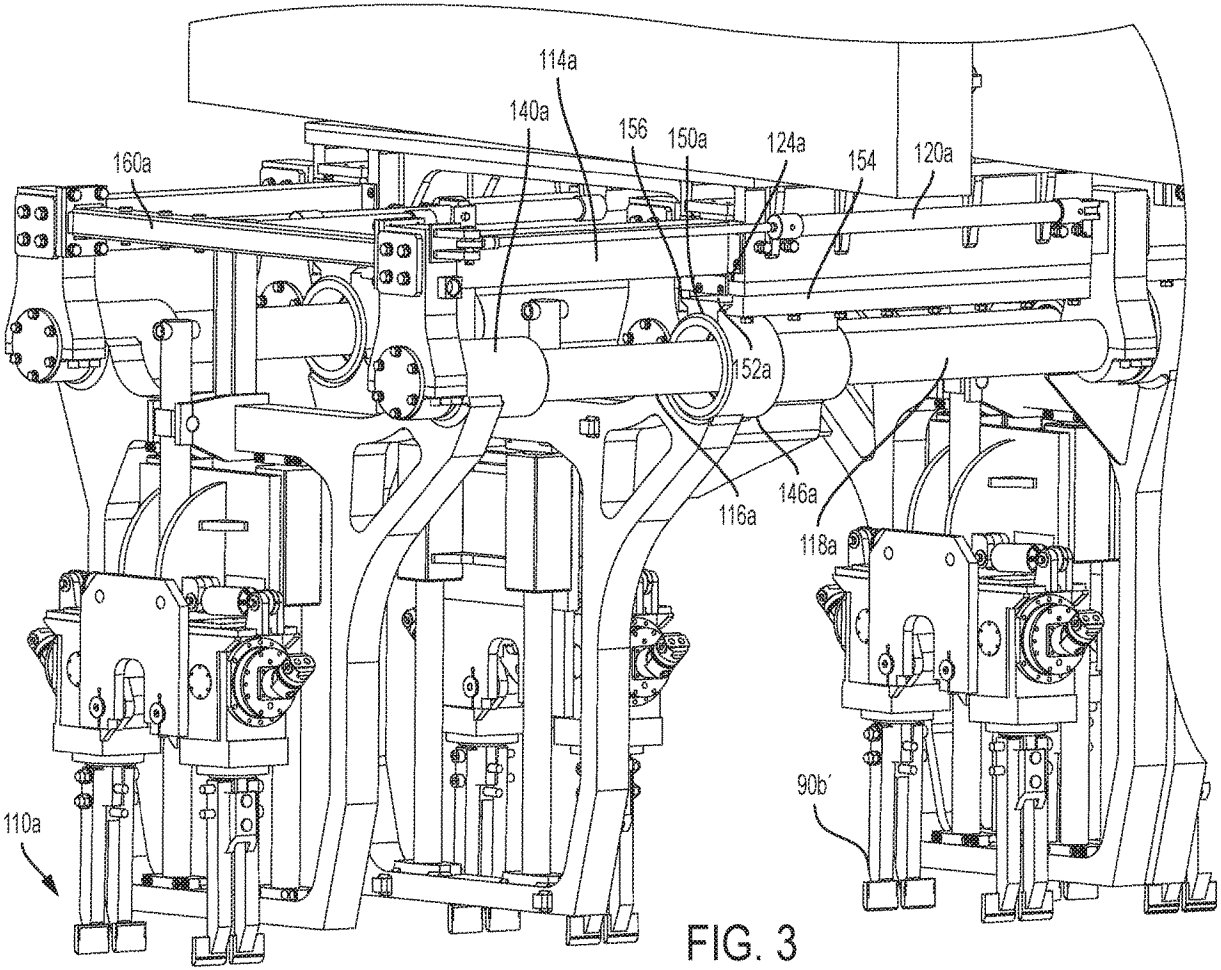
FIG. 3 illustrates a partial perspective view of the exemplary workhead assemblies of FIG. 1.
Figure 4:
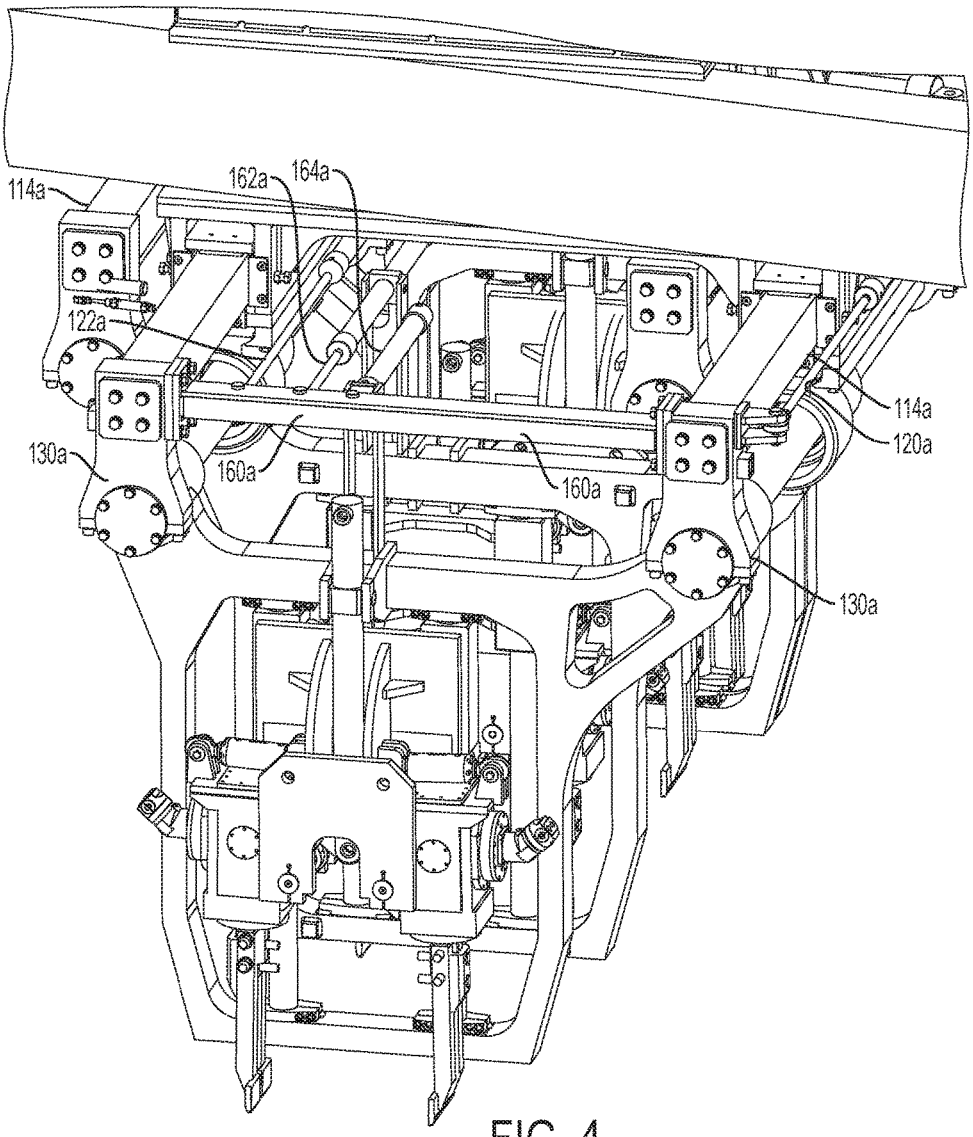
FIG. 4 illustrates a partial perspective view of the exemplary workhead assemblies of FIG. 1.
Figure 5:
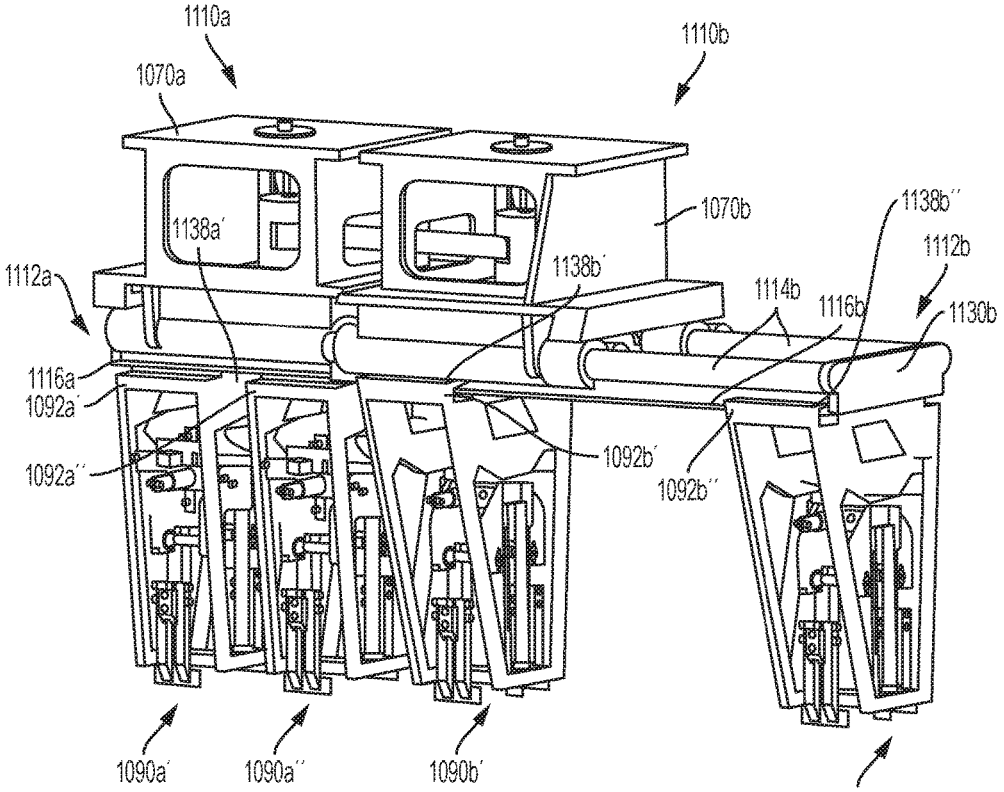
FIG. 5 illustrates a perspective view of exemplary workhead assemblies.
Figure 6:
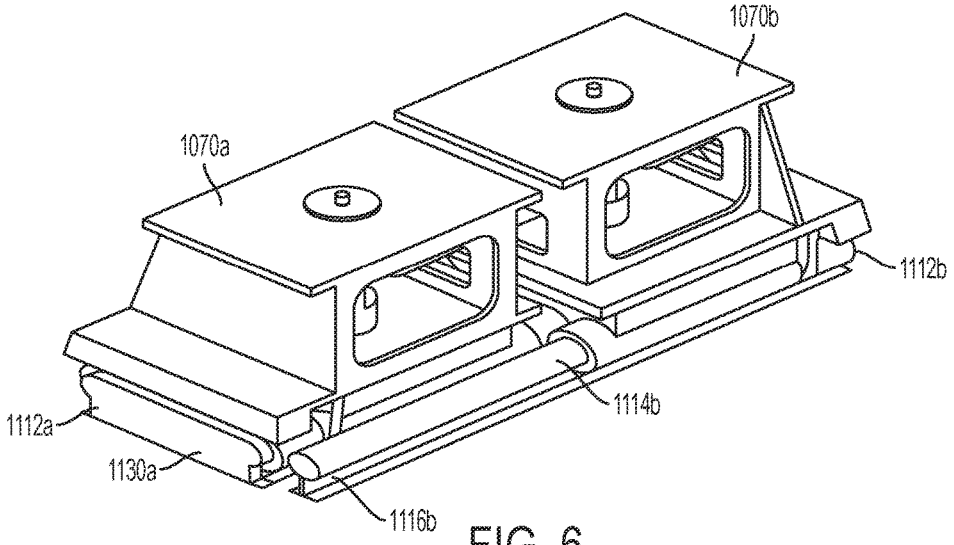
FIG. 6 illustrates a perspective view of two exemplary carriage assemblies of the exemplary workhead assemblies of FIG. 5.

Displacement of the carriers 92' and 92" may be provide by actuators such as hydraulic actuators. With reference to FIGS. 3 and 4, each workhead assembly 110 may include two (a front and a back) of the dual beam assemblies 112, which may be coupled by a connecting beam 160 coupled to the end plates 130. An actuator 162*a* may be coupled between the connecting beam 160 and the inner carrier 92" to adjust the transverse position of the inner carrier 92" with respect to the connecting beam 160. An actuator 164*a* may be coupled between the connecting beam 160 and the outer carrier 92' (for example via the armature 142*a*) to adjust the transverse position of the outer carrier 92" with respect to the connecting beam 160. The transverse position of the connecting beam 160 may be adjusted by the actuators 120 and 122, which are coupled between the connecting beam 160 and the end plate 130 on the one hand and the carriage subframe 72 on the other hand. Thus, the transverse position of the workheads 90 may be adjusted both inward and outward in the transverse direction independently.

Referring to FIGS. 5-8, the workhead assemblies 1110 perform rail maintenance operations via workheads 1090' and 1090" extending downwardly therefrom. It will be appreciated that the inclusion of two workhead assemblies is exemplary and any number of workhead assemblies may be used.

The workhead assembly 1110 is coupled to the frame of a rail vehicle via the carriage 1070. The workheads 1090' and 1090" are respectively coupled to the carriage 1070 via carriers 1092' and 1092". The carriage 1070 includes a beam assembly 1112 that includes a rod 1114 with an I-beam 1116. The beam assembly 1112 is transversely (e.g., transverse to the longitudinal axis of the track) extendable from a the carriage 1070. The carriage 1070 may include a fixed tube from which the displaceable rod 1114 with I-beam 1116 may be displaced. When retracted, the rod 1114 may be partially or fully disposed within the tube. The tube may be integrally formed with the carriage 1070 such that the tube is fixed thereto. Further, the I-beam may be welded to the rod. The carriers 1092 include the inward protrusions 1138 to couple the carriers 1092 to the I-beam 1116. A distance between a pair of the inward protrusions 1130 on each carrier 1092 may be less than a width of the I-beam 1116. It will be appreciated that the I-beam may be replaced with a T-beam, a pair of flat plates formed in a T-shape, and so forth. Preferably, the I-beam includes a flared end such that it is narrower proximal to the rod 1114 and wider distal to the rod 1114.

Figure 7:
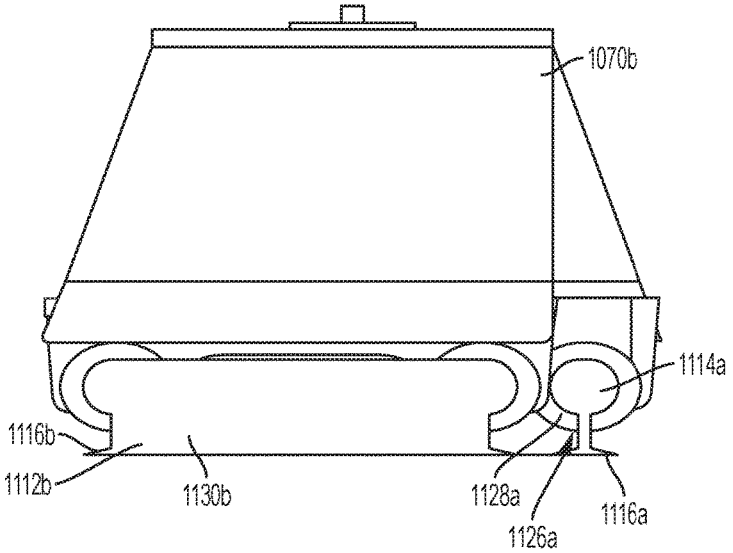
FIG. 7 illustrates a side view of the exemplary carriage assemblies of FIG. 6.

With reference to FIG. 7, to accommodate the I-beam, the tube 1128 includes a notch 1126 formed along the length of the bottom surface of the tube 1128 such that the stem of the I-beam 1116 passes through the notch 1126 to permit the base of the I-beam 1116 to carry the workheads. In this manner, movement of the rod 1114 and I-beam 1116 imparts movement to the workheads 1090. The rod 1114 with I-beam 1116 may be actuated via a hydraulic cylinder, which is coupled to an end plate 1130 of the and the carriage 1070. This allows the workhead to be transversely displaced to an extended position relative to the longitudinal axis of the rail machine.

Figure 8:
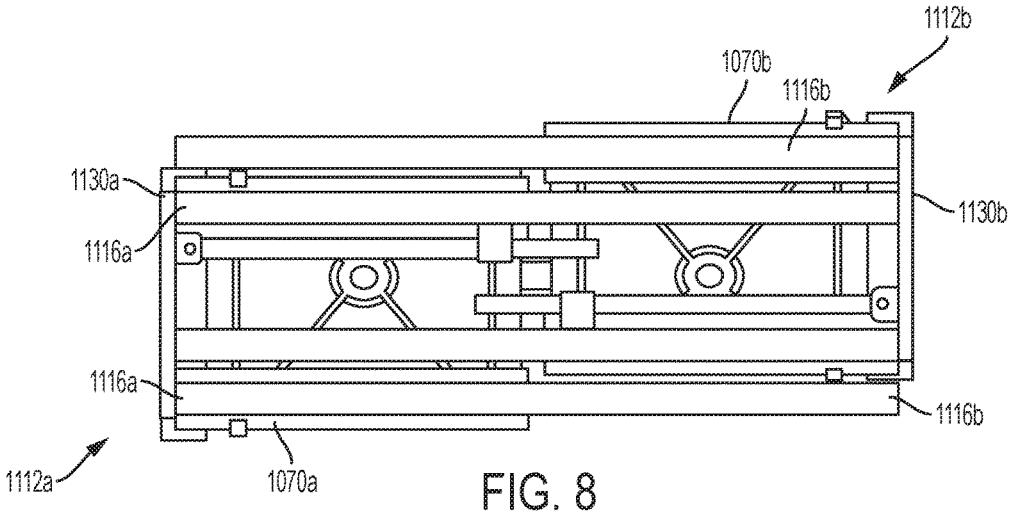
FIG. 8 illustrates a bottom view of the exemplary carriage assemblies of FIG. 6.

With reference to FIG. 8, the dual carriage workhead assembly may includes four rods with I-beams. Each rod 1114 with I-beam 1116 is associated with a hydraulic cylinder to impart movement to the rod with I-beam. Accordingly, the outer workheads 1090*a*' and 1090*b*" may be actuated to extend outwardly to address irregular track structure. For example, the outer workheads 1090*a*' and 1090*b*" may be extended to tamp rail areas of increased distance between the rails.

Figure 9:
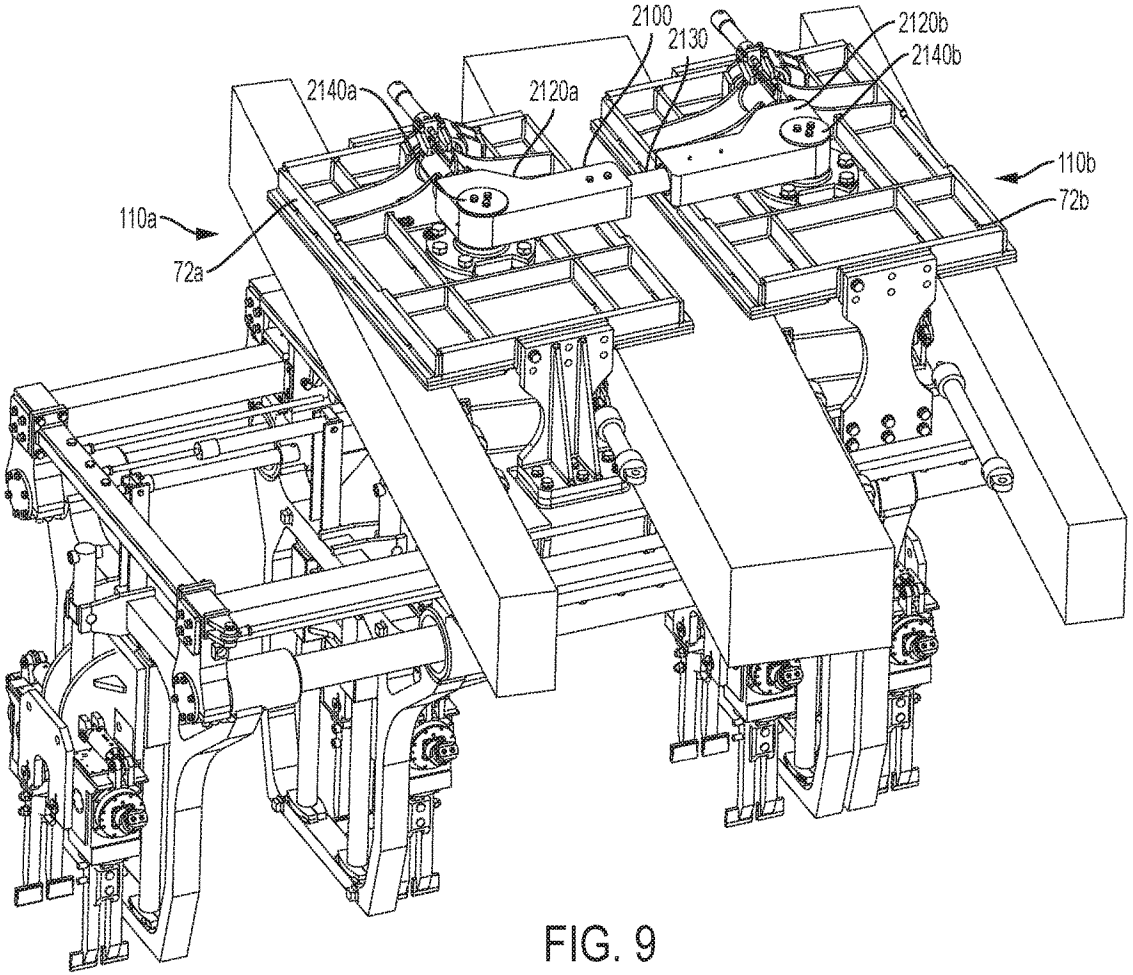
FIG. 9 illustrates a perspective view of the exemplary workhead assemblies of FIG. 1 in a rotated orientation.
Figure 10:
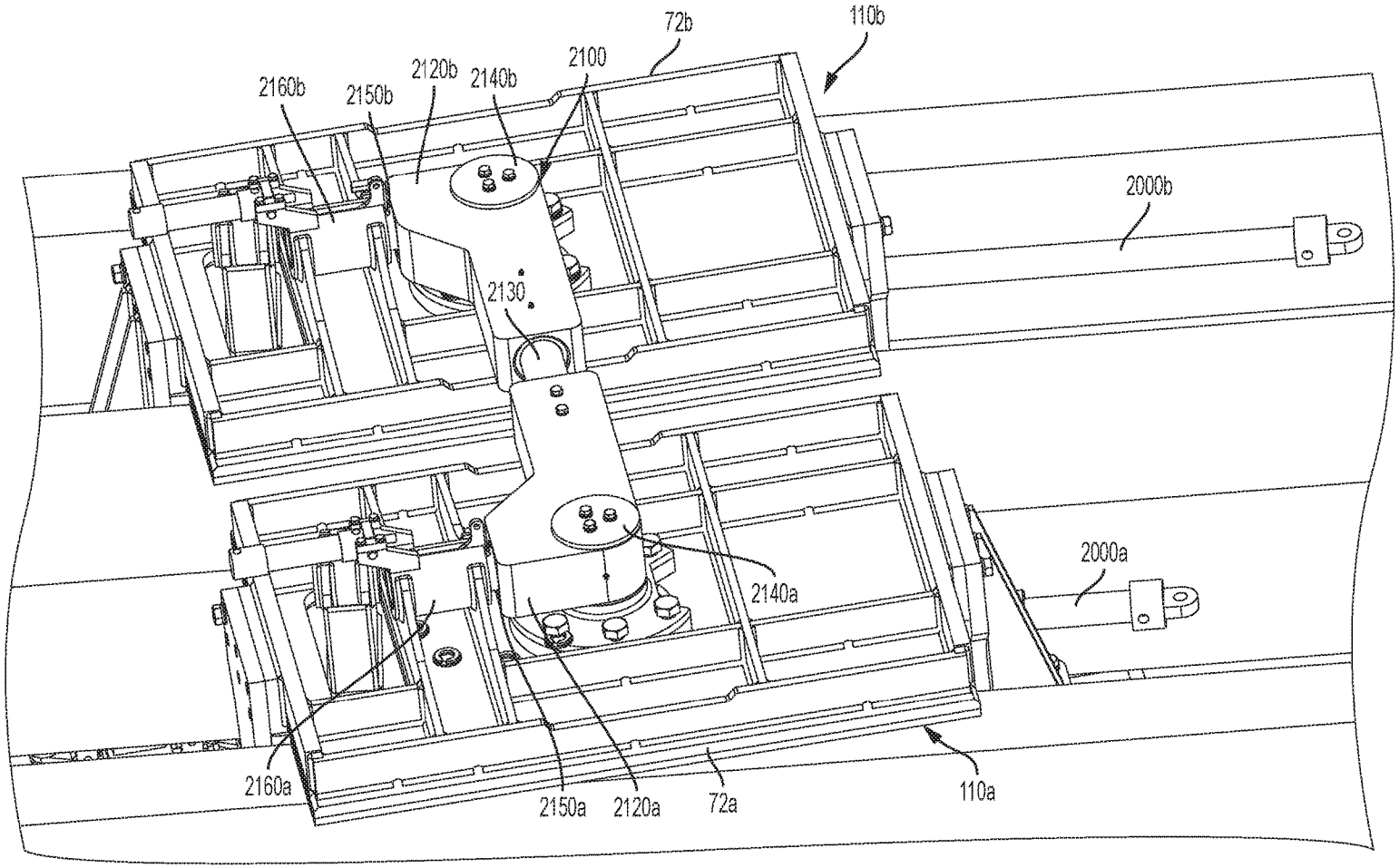
FIG. 10 illustrates a perspective view of the exemplary workhead assemblies of FIG. 1 in a rotated orientation.
Figure 11:
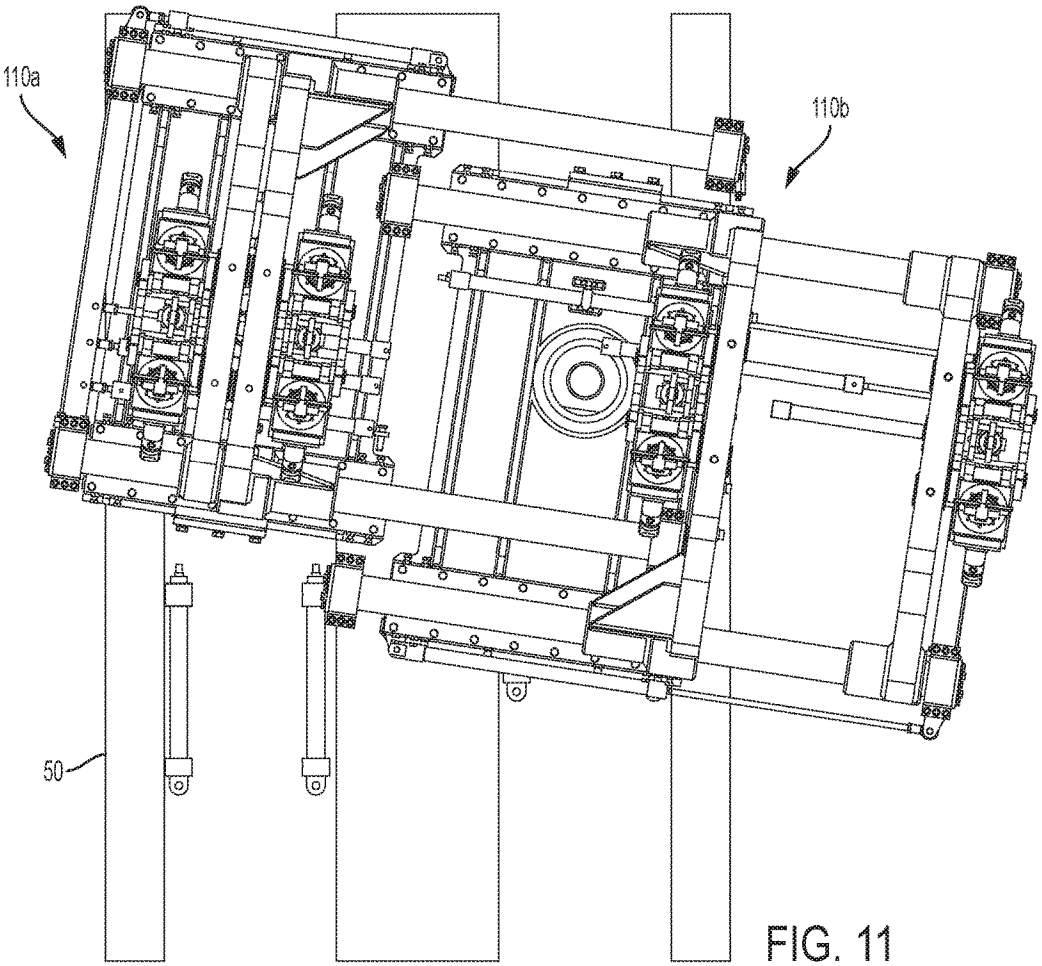
FIG. 11 illustrates a bottom view of the exemplary workhead assemblies of FIG. 1 in a rotated orientation.

Referring to FIGS. 9-11, the workhead assemblies are capable of translation in the longitudinal direction and also rotation about the vertical direction. Actuators, such as hydraulic actuators, 2000 couple the workhead assemblies 110 to the frame 50. Extension and retraction of the actuators 2000 therefore moves the workhead assemblies 110 in the longitudinal direction with respect to the frame 50.

The workhead assembly 110*a* may be coupled to the workhead assembly 110*b* by the connecting rod assembly 2100. The connecting rod assembly 2100 may include the housings 2120 coupled via the rod 2130. The housings 2120 are coupled to the subframe 72 via the vertically oriented pin 2140 and the locking pin 2150. The locking pin locks the rotation of the housing 2120 with respect to the pin sleeve 2160 of the subframe 72.

The rod 2130 is free to slide in and out of at least one of the housings 2120. The rod 2130 may also, or alternatively, be extendable or telescoping. In this way, the distance between the workhead assemblies 110 may vary but their angular orientation with respect to each other is constrained by the housings 2120 locked with the pin sleeves 2150 by the locking pins 2150. When the actuators 2000 are set to different lengths and the locking pins 2150 are engaged with the housings 2120, the workhead assemblies 110 rotate with respect to the frame 50 to maintain their orientation with respect to each other.

Figure 12:
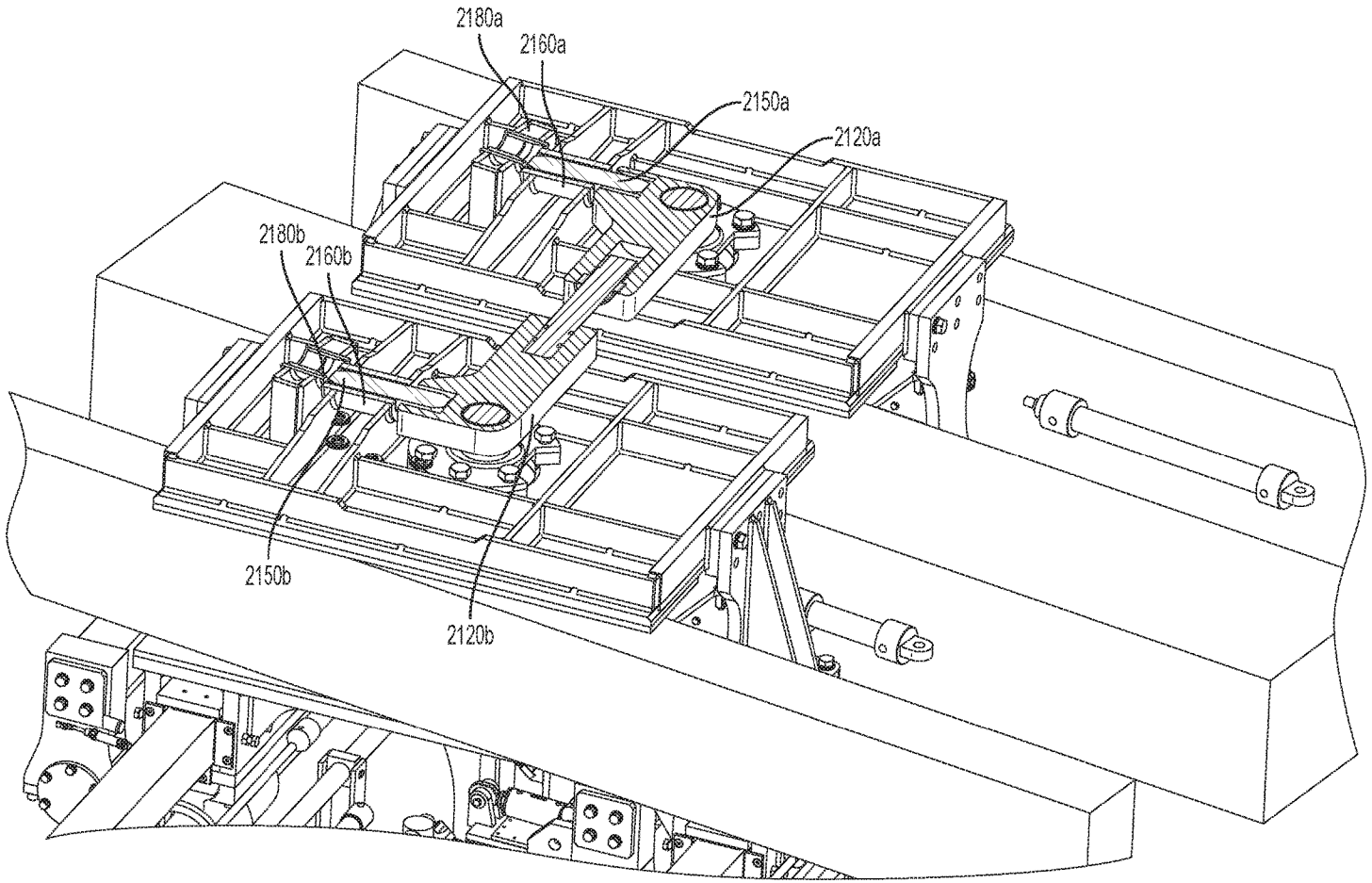
FIG. 12 illustrates a cross-sectional perspective view of a connecting rod assembly of exemplary workhead assemblies of FIG. 1 in a rotated orientation.
Figure 13:
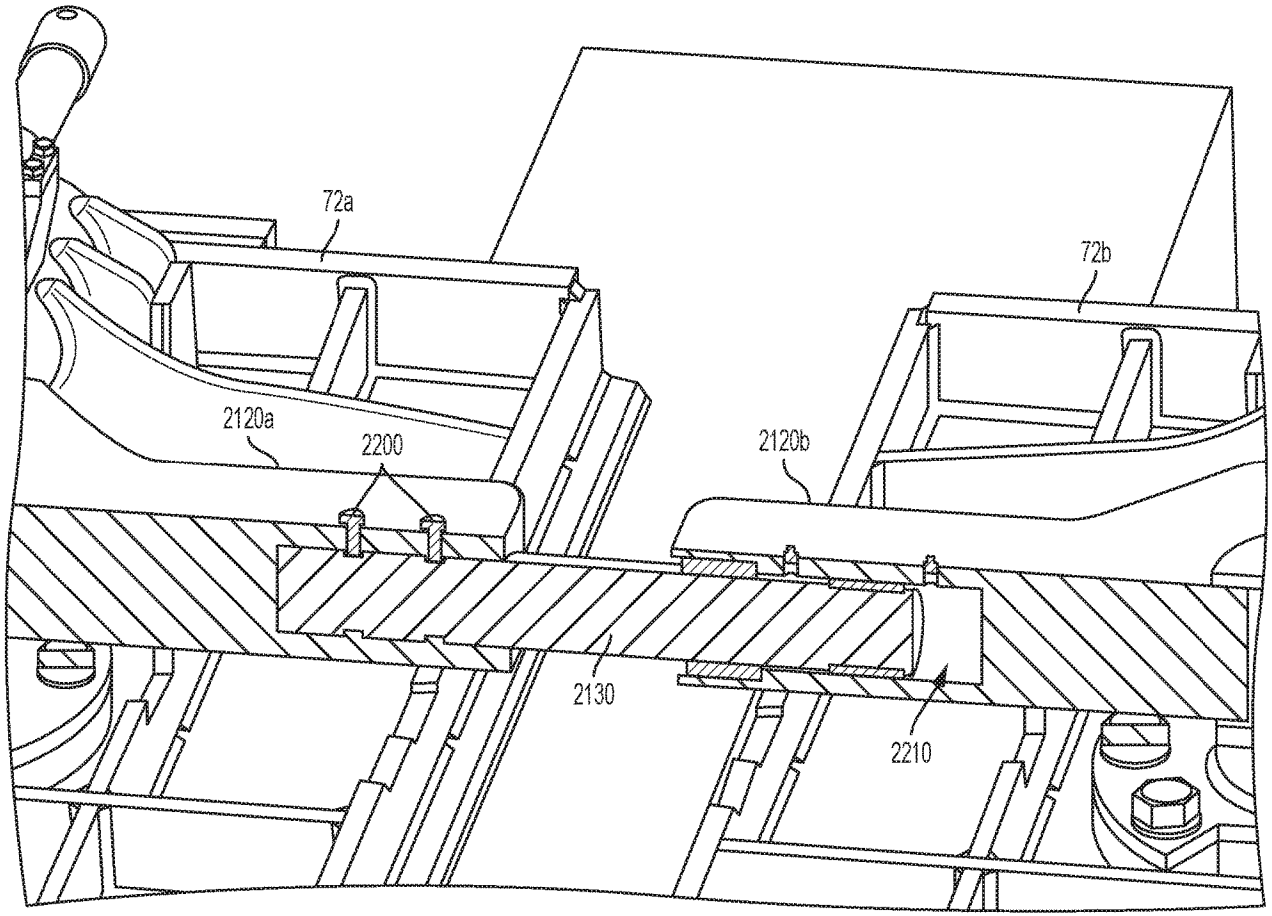
FIG. 13 illustrates a cross-sectional perspective view of a connecting rod assembly of exemplary workhead assemblies of FIG. 1.
Figure 14:
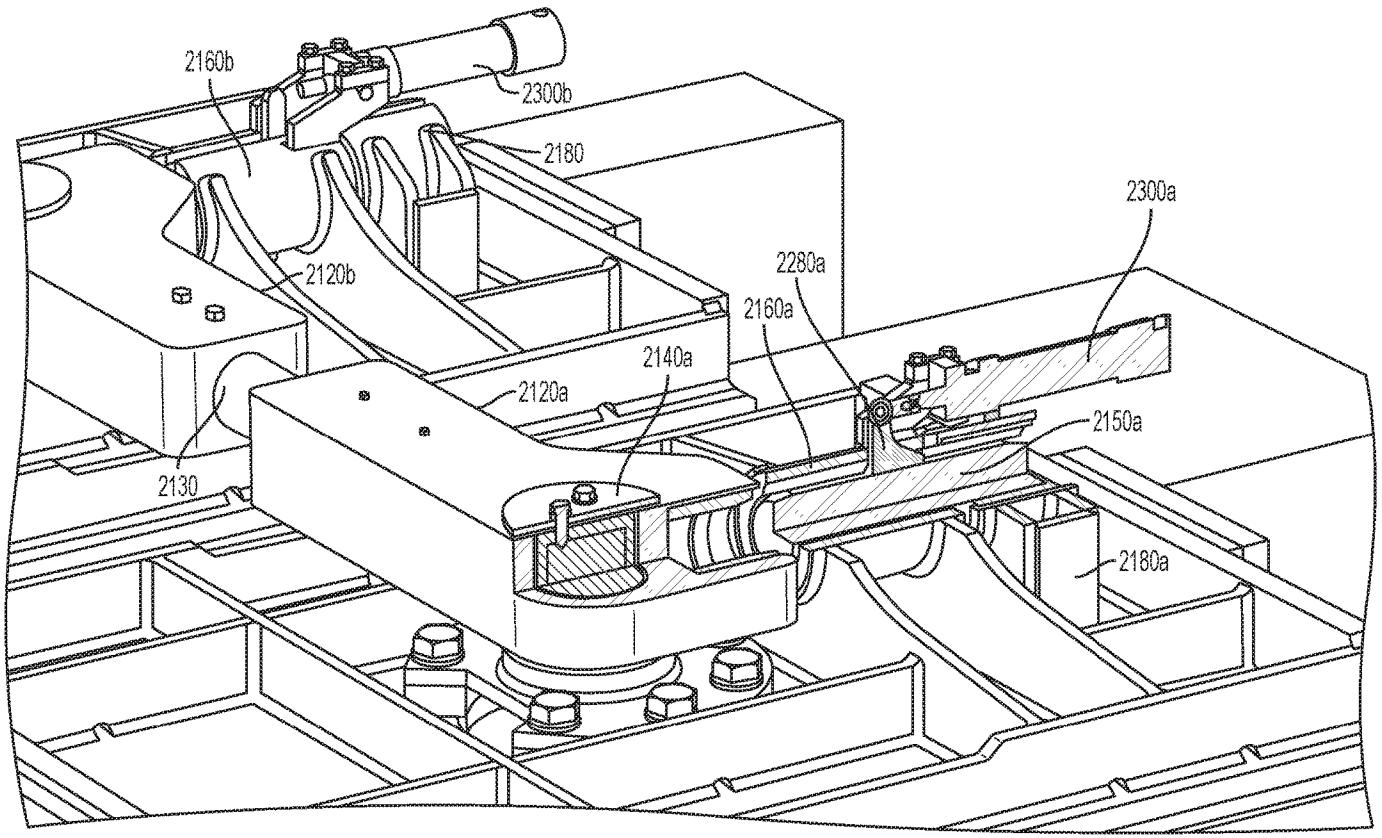
FIG. 14 illustrates a sectional perspective view of a connecting rod assembly of exemplary workhead assemblies of FIG. 1 in a square orientation.
Figure 15:
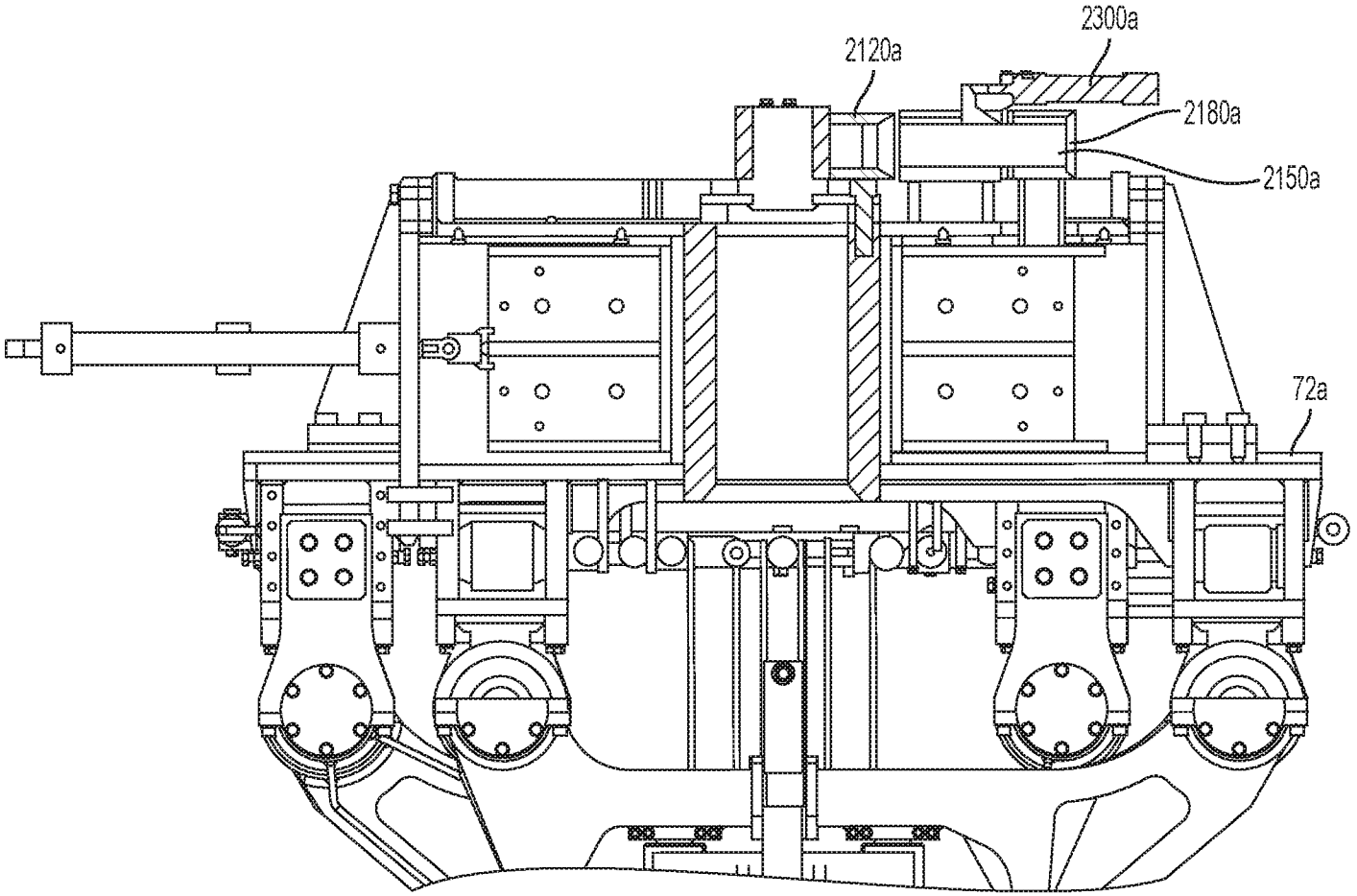
FIG. 15 illustrates a sectional side view of a connecting rod assembly of exemplary workhead assemblies of FIG. 1 in a square orientation.
Figure 16:
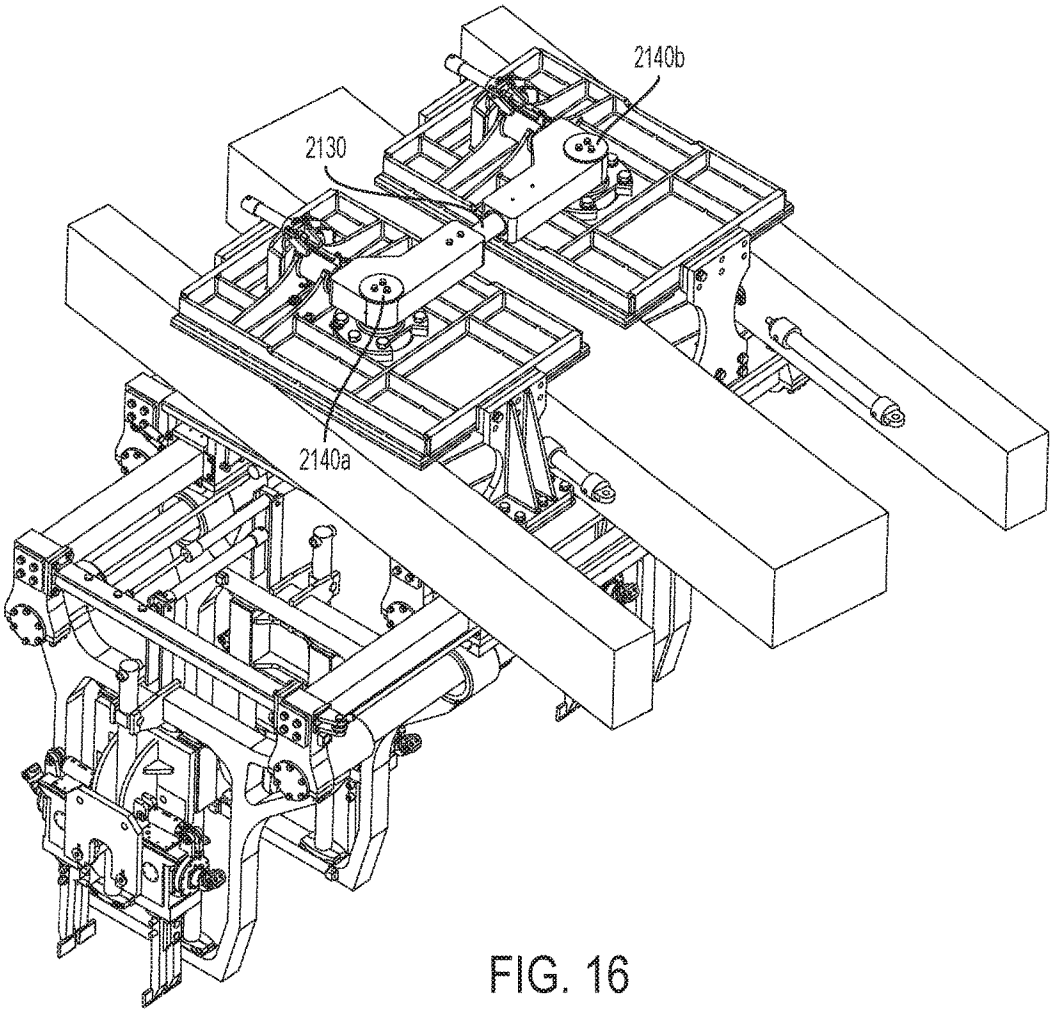
FIG. 16 illustrates a perspective view of exemplary workhead assemblies of FIG. 1 in a square orientation.
Figure 17:
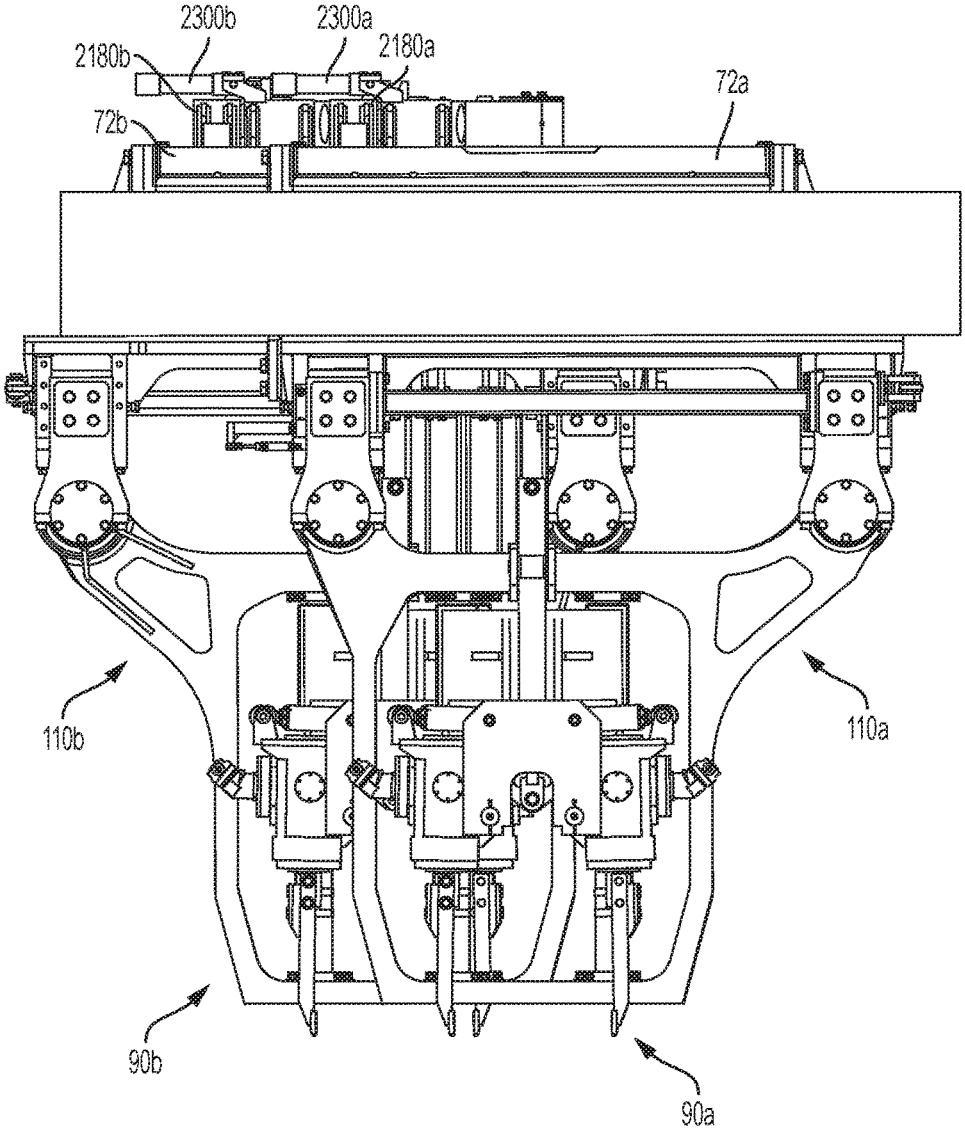
FIG. 17 illustrates a side view of exemplary workhead assemblies of FIG. 1 in a square orientation.

Referring to FIGS. 12 and 13, the locking pin 2150 can selectively engage the housing 2120. When the locking pin 2150 is engaged with the housing 2120, it may be disengaged with the longitudinal carrier 2180, which is coupled to the actuator 2000. The rod 2130 may be secured at one end to one of the housings 2120 by set screws 2200 and free to slide in an out of a cavity 2210 at another end at the other housing 2120.

In this orientation, differential actuation of the actuators 2000 will rotate the workhead assemblies 110 about the vertical direction. From a neutral orthogonal position, when one of the actuators 2000 is actuated, the rod 2130 translates/increases in length, thus transferring rotation of one pin 2140*a* to the other pin 2140*b*. This results in rotation of the subframes 72 (and attached workheads 90) about a vertical axis defined through the pins 2140. Angle control is directly related to the relative longitudinal distance of the two workhead assemblies 110. In this manner, the workheads 90 can be rotated to accommodate irregular track structure, such as skewed ties in a switch.

With reference to FIGS. 14-17, the locking pin 2150 may disengage the housing 2120 and engage the longitudinal carrier 2180. When the locking pin is engaged with the longitudinal carrier, the orientation of the subframe 72 is maintained with respect to the longitudinal carrier and the frame 50. This may be referred to as a square orientation. Disengagement of the locking pin 2150 from the housing 2120 permits the housing 2120 to rotate about the pin 2140 and therefore the angular relation of the workhead 110*a* is not constrained with respect to the workhead 110*b*.

The locking pin 2150 may include an arm 2280 coupled to an actuator 2300 operable to cause the locking pin 2150 to translate in the longitudinal direction with respect to the pin sleeve 2160. The actuator 2300 can thereby select whether the workheads 110 rotate or maintain a square orientation.

Figure 19:
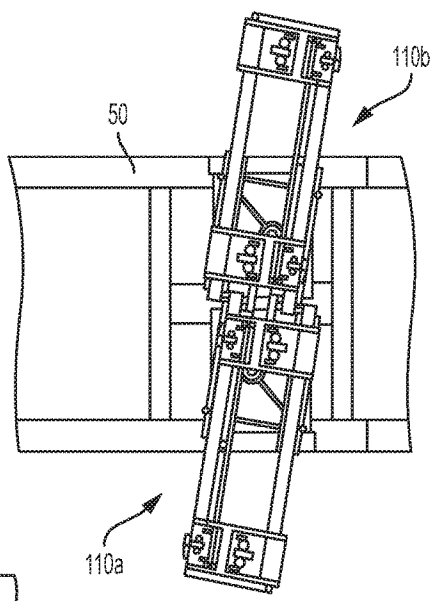
FIG. 19 illustrates a bottom view of exemplary workhead assemblies in an extended and rotated orientation.
Figure 20:
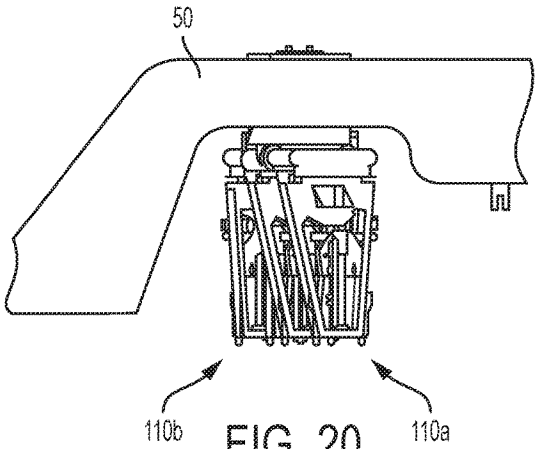
FIG. 20 illustrates a side view of exemplary workhead assemblies in an extended and rotated orientation.
Figure 18:
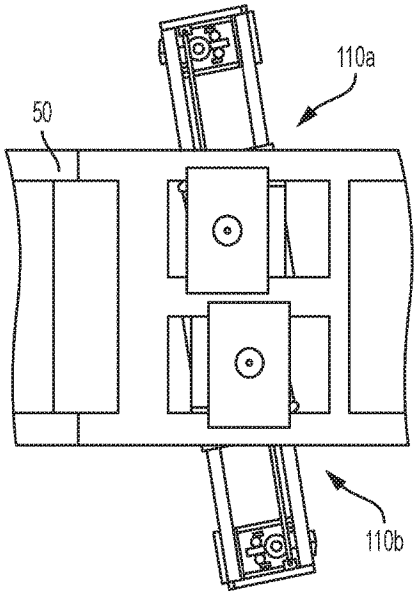
FIG. 18 illustrates a top view of exemplary workhead assemblies in an extended and rotated orientation.

With reference to FIGS. 18-20, the workhead assemblies 110 may be both rotated and extended. In operation, should extension and rotation be desired, the workhead assemblies 110 may be rotated by using the actuators 2000 to impart a force on the workhead assemblies 110 in the longitudinal direction of the rail machine. If the locking pins 2150 are engaged with the housings 2120, this will cause rotation of the workhead assemblies 2150 about the pins 2140 via the rod 2130 interconnecting the workhead assemblies 2150.

The outer workheads may be extended by using the actuator associated with the rod with I-beam (FIGS. 5-8) or the dual beam (FIGS. 1-4) to impart a force to extend the workhead assemblies in a transverse direction away from the rail vehicle. The outer workheads 90 are thus carried to an extended position away from the rail vehicle 100 as discussed above. Of course, the operations may be reversed with extension occurring first, and then rotation or the extension and rotation occurring at the same time.

It is to be appreciated that the rail vehicle with dual carriage workhead assemblies may be modified. For example, while the dual carriage workhead assembly is described as able to both rotate about a vertical axis as well as move along an axis transverse to the longitudinal axis of the rail machine, in some embodiments, the dual carriage workhead assembly may only be capable of rotating and, in other embodiments, the dual carriage workhead assembly may only be capable of movement along the transverse axis.

While various embodiments in accordance with the disclosed principles have been described above, it should be understood that they have been presented by way of example only, and are not limiting. For example, in some embodiments, the lower beam may be coupled to the pocket assembly via a dovetail slide. A protrusion extending from the lower beam may slide along the dovetail slide. Thus, the breadth and scope of the invention(s) should not be limited by any of the above-described exemplary embodiments, but should be defined only in accordance with the claims and their equivalents issuing from this disclosure. Furthermore, the above advantages and features are provided in described embodiments, but shall not limit the application of such issued claims to processes and structures accomplishing any or all of the above advantages.

While any discussion of or citation to related art in this disclosure may or may not include some prior art references, applicant neither concedes nor acquiesces to the position that any given reference is prior art or analogous prior art.

The foregoing description, for purpose of explanation, has been described with reference to specific embodiments. However, the illustrative discussions above are not intended to be exhaustive or to limit the invention to the precise forms disclosed. Many modifications and variations are possible in view of the above teachings. The embodiments were chosen and described in order to explain the principles of the invention and its practical applications, to thereby enable others skilled in the art to utilize the invention and various embodiments with various modifications as are suited to the particular use contemplated.

It will be apparent to those skilled in the art that various changes and modifications may be made without departing from the spirit and scope of the embodiments as defined in the following claims.

The embodiments discussed have been presented by way of example only and not limitation. Thus, the breadth and scope of the invention(s) should not be limited by any of the above-described exemplary embodiments, but should be defined only in accordance with the following claims and their equivalents. Moreover, the above advantages and features are provided in described embodiments, but shall not limit the application of the claims to processes and structures accomplishing any or all of the above advantages.

Additionally, the section headings herein are provided for consistency with the suggestions under 37 CFR 1.77 or otherwise to provide organizational cues. These headings shall not limit or characterize the invention(s) set out in any claims that may issue from this disclosure. Specifically and by way of example, the claims should not be limited by the language chosen under a heading to describe the so-called technical field. Further, a description of a technology in the "Background" is not to be construed as an admission that technology is prior art to any invention(s) in this disclosure. Neither is the "Brief Summary" to be considered as a characterization of the invention(s) set forth in the claims found herein. Furthermore, any reference in this disclosure to "invention" in the singular should not be used to argue that there is only a single point of novelty claimed in this disclosure. Multiple inventions may be set forth according to the limitations of the multiple claims associated with this disclosure, and the claims accordingly define the invention(s), and their equivalents, that are protected thereby. In all instances, the scope of the claims shall be considered on their own merits in light of the specification, but should not be constrained by the headings set forth herein.

The invention claimed is:

1. A rail vehicle, comprising:

a rail vehicle frame;

a pocket coupled to a frame portion of the rail vehicle frame;

a first beam disposed in a cavity defined by the pocket, the first beam having a rectangular cross-section;

a second beam disposed proximal to the first beam;

an end plate that couples the first beam and the second beam;

an actuator that extends the first and second beams such that the end plate is displaced transversely with respect to the rail vehicle frame; and a workhead carrier operable to translate along the first and second beams and couple the second beam to the frame portion.

2. The rail vehicle of claim 1, wherein the pocket includes a pocket weldment.

3. The rail vehicle of claim 1, wherein the pocket weldment includes a plurality of plates arranged in a rectangular shape.

4. The rail vehicle of claim 1, wherein the second beam has a cylindrical shape.

5. The rail vehicle of claim 4, wherein the workhead carrier includes a sleeve disposed about the second beam.

6. The rail vehicle of claim 1, further comprising:
a second pocket coupled to the rail vehicle frame;
a third beam disposed in a cavity defined by the second pocket;
a fourth beam disposed proximal to the third beam;
a second end plate that couples the third beam and the fourth beam;
a second actuator that extends the third and fourth beams such that the second end plate is displaced transversely with respect to the rail vehicle frame; and
a second workhead carrier operable to translate along the fourth beam.

7. The rail vehicle of claim 1, further comprising a carriage subframe coupled to the rail vehicle frame, wherein the pocket is disposed in the subframe.

8. The rail vehicle of claim 7, wherein the carriage subframe includes a slot, and the workhead carrier includes a protrusion disposed within the slot thereby coupling the second beam to the carriage subframe.

9. The rail vehicle of claim 8, wherein the protrusion and slot provide a dovetail joint.

10. The rail vehicle of claim 1, wherein the rectangular cross-section of the first beam is a square cross-section.

11. A rail vehicle, comprising:
a rail vehicle frame;
a pocket coupled to a frame portion of the rail vehicle frame;
a first beam disposed in a cavity defined by the pocket;
a second beam disposed proximal to the first beam;
an end plate that couples the first beam and the second beam;
an actuator that extends the first and second beams such that the end plate is displaced transversely with respect to the rail vehicle frame;
a workhead carrier operable to translate along the first and second beams and couple the second beam to the frame portion;
a second pocket coupled to the rail vehicle frame;
a third beam disposed in a cavity defined by the second pocket;
a fourth beam disposed proximal to the third beam;
a second end plate that couples the third beam and the fourth beam;
a second actuator that extends the third and fourth beams such that the second end plate is displaced transversely with respect to the rail vehicle frame; and
a second workhead carrier operable to translate along the fourth beam;
wherein the first and second end plates are coupled by a connecting beam.

12. The rail vehicle of claim 11, wherein a second actuator is coupled between the connecting beam and workhead carrier, and a third actuator is coupled between the second workhead carrier and one of the connecting beam or the second end plate.

13. A rail vehicle, comprising:
a rail vehicle frame and a carriage subframe coupled to the rail vehicle frame;
a pocket disposed in the carriage subframe;
a first beam disposed in a cavity defined by the pocket;
a second beam disposed proximal to the first beam;
an end plate that couples the first beam and the second beam;
an actuator that extends the first and second beams such that the end plate is displaced transversely with respect to the rail vehicle frame; and
a workhead carrier operable to translate along the first and second beams and couple the second beam to the frame portion;
wherein the carriage subframe includes a slot, and the workhead carrier includes a protrusion disposed within the slot thereby coupling the second beam to the carriage subframe.

14. The rail vehicle of claim 13, wherein the protrusion and slot provide a dovetail joint.

15. A rail vehicle, comprising:
a rail vehicle frame;
a first carriage assembly including
a first pocket defined in a frame of the first carriage assembly,
a first beam disposed in a cavity defined by the pocket,
a second beam disposed proximal to the first beam,
a first end plate that couples the first beam and the second beam,
a first actuator that extends the first and second beams such that the first end plate is displaced transversely with respect to the rail vehicle frame, and
a first workhead carrier operable to translate along the first and second beams and couple the second beam to the frame of the first carriage assembly;
a second carriage assembly including
a second pocket defined in a frame of the second carriage assembly,
a third beam disposed in a cavity defined by the second pocket,
a fourth beam disposed proximal to the third beam,
a second end plate that couples the third beam and the fourth beam,
a second actuator that extends the third and fourth beams such that the second end plate is displaced transversely with respect to the rail vehicle frame, and
a second workhead carrier operable to translate along the third and fourth beams and couple the fourth beam to the frame of the second carriage assembly;
a connection beam that couples the first carriage assembly to the second carriage assembly; and
a third actuator that displaces the first carriage assembly in a longitudinal direction with respect to the rail vehicle frame, and further wherein;
the first carriage assembly includes a first connection housing coupled to the frame of the first carriage assembly by a first pin extending from the frame of the first carriage assembly in a vertical direction, and
the second carriage assembly includes a second connection housing coupled to the frame of the second carriage assembly by a second pin extending from the frame of the second carriage assembly in the vertical direction, and
the first connection housing and the second connection housing are coupled by the connection beam.

16. The rail vehicle of claim 15, wherein the connection beam is free to translate within at least one of the first and second connection housings.

17. The rail vehicle of claim 15, further comprising a first locking pin operable to limit rotation of the first housing about the first pin, and a second locking pin operable to limit rotation of the second housing about the second pin.

18. The rail vehicle of claim 17, wherein the first locking pin is disposed in a first pin sleeve, the first locking pin is operable to extend from a first side of the first pin sleeve into the first connection housing to limit the rotation of the first connection housing about the first pin, and the first locking pin is operable to extend from a second side of the first pin sleeve into a longitudinal carrier coupled to the third actuator.

19. The rail vehicle of claim 18, wherein the first connection housing rotates about the first pin when the first locking pin is engaged with the longitudinal carrier.

20. The rail vehicle of claim 18, wherein the first locking pin includes an arm extending therefrom coupled to an actuator to selectively engage either the first connection housing of the longitudinal carrier.

* * * * *